United States Patent [19]

Takahashi et al.

[11] Patent Number: 4,926,925

[45] Date of Patent: May 22, 1990

[54] POURING APPARATUS FOR MOVING-MOLD TYPE CONTINUOUS CASTING MACHINE

[75] Inventors: Shuzo Takahashi, Yokohama; Yutaka Tsuchida, Yokosuka; Shiro Osada, Yokohama; Nobuhisa Hasebe, Yokohama; Masayuki Nakada, Yokohama, all of Japan

[73] Assignees: Ishikawajima-Harima Jukogyo Kabushiki Kaisha; Nippon Kokan Kabushiki Kaisha, both of Japan

[21] Appl. No.: 352,862

[22] Filed: May 17, 1989

[30] Foreign Application Priority Data

Jun. 8, 1988 [JP] Japan ..... 63-141350

[51] Int. Cl.[5] ..... B22D 11/06; B22D 11/18

[52] U.S. Cl. ..... 164/154; 164/431; 164/438

[58] Field of Search ..... 164/452, 453, 481, 488, 164/154, 430, 431, 432, 433, 434, 437, 438

[56] References Cited

U.S. PATENT DOCUMENTS

4;544,018 10/1985 Figge et al. ..... 164/438
4,830,089 5/1989 Carmichael et al. ..... 164/481

FOREIGN PATENT DOCUMENTS 234750 11/1985 Japan .
60249776 5/1987 Japan ..... 164/430
183959 10/1987 Japan .

*Primary Examiner*—Richard K. Seidel
*Assistant Examiner*—Rex E. Pelto

[57] ABSTRACT

Position sensors at an inlet of a mold cavity defined by upper and lower block molds detect distances from the passing upper and lower block molds. In response to outputs from the position sensors, any deflection of the leading end of the tundish nozzle, which can be inclined with respect to the melt outlet of a tundish, toward the upper or lower block molds defining the mold cavity is detected by a control device to generate a drive signal which is delivered to a hydraulic cylinder adapted to incline the tundish nozzle by extending or retracting the rod thereof, whereby the gaps between the leading end of the tundish nozzle and the upper and lower block molds are maintained uniform.

1 Claim, 7 Drawing Sheets

POURING APPARATUS FOR MOVING-MOLD TYPE CONTINUOUS CASTING MACHINE

BACKGROUND OF THE INVENTION

The present invention relates to a pouring apparatus for a moving-mold type continuous casting machine.

FIG. 1 shows a conventional moving-mold type continuous casting machine comprising a plurality of block molds 1 interconnected in the form of a pair of endless mold assemblies 2 and 2'. Such mold assemblies 2 and 2' are disposed one upon another to define a continuous mold cavity between them. While the mold assemblies 2 and 2' are driven by drive wheels 3 and 3' in a direction indicated by arrows 4 and 4', melt is poured into the mold cavity at one side of the cavity through a tundish nozzle 6 extending from a tundish 5 and a cast strand 7 is withdrawn from the other side of the mold cavity as indicated by arrow.

In order to prevent leakage of melt in the continuous casting machine of the type described above, a gap between the tundish nozzle 6 in the mold cavity and the block molds 1 defining the mold cavity must be kept at a predetermined small value with a high degree of dimensional accuracy.

To this end, conventionally used is a tundish-nozzle aligning system as shown in FIGS. 2–5 in which vertical position as well as nose-up and nose-down of the nozzle can be adjusted by operating handlewheels 45 operatively connected to jacks 44 mounted on a tundish-supporting stand 48. Horizontal position of the nozzle 6 can be adjusted by moving jack stand 49 located below the tundish-supporting stand 48 by operating push bolts 46 and draw bolts 47 as shown in FIG. 4. As best shown in FIG. 5, rotational alignment (inclination in a plane perpendicular to a nozzle axis) of the nozzle can be adjusted by adjusting nuts 53 of specially designed bolts 52 pivotably joined with pivot pins 51 to a car frame 50.

However, use of the tundish-nozzle aligning system is not always effective for keeping the gap between the nozzle and the block molds at a predetermined small value. Because, any vertical deviation of the individual block molds 1 must be absorbed by adjusting the nozzle 6 through manual operation of the handlewheels 45. This is practically impossible, resulting in failure of maintaining the above-described predetermined gap. As a result, the tundish nozzle 6 strongly contacts the molds 1 and is nonuniformly worn or damaged.

The present invention was made to substantially overcome the above and other problems encountered in the conventional pouring apparatuses for moving-mold type continuous casting machines and has for its object to properly maintain a predetermined small gap between the tundish nozzle and the block molds all the time, thereby ensuring the safety of the tundish nozzle and the moving molds. The present invention will become more apparent from the following description of a preferred embodiment thereof taken in conjunction with the accompanying drawings.

BRIEF DESCRIPTION OF THE PREFERRED EMBODIMENT

DETAILED DESCRIPTION OF THE PREFERRED EMBODIMENT

Figure 1:
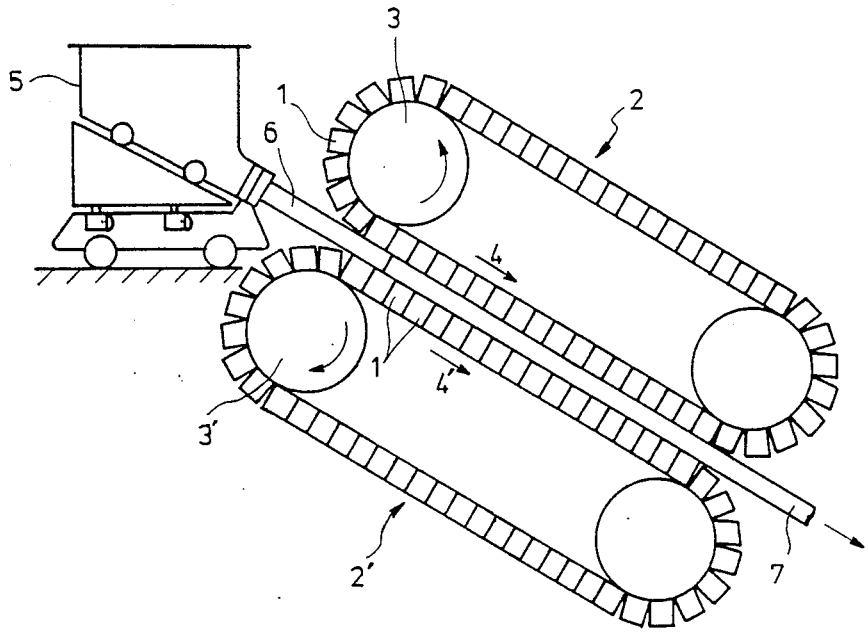
Fig. 1 PRIOR ART
FIG. 1 is a side view of a conventional moving-mold type continuous casting machine.
Figure 2:
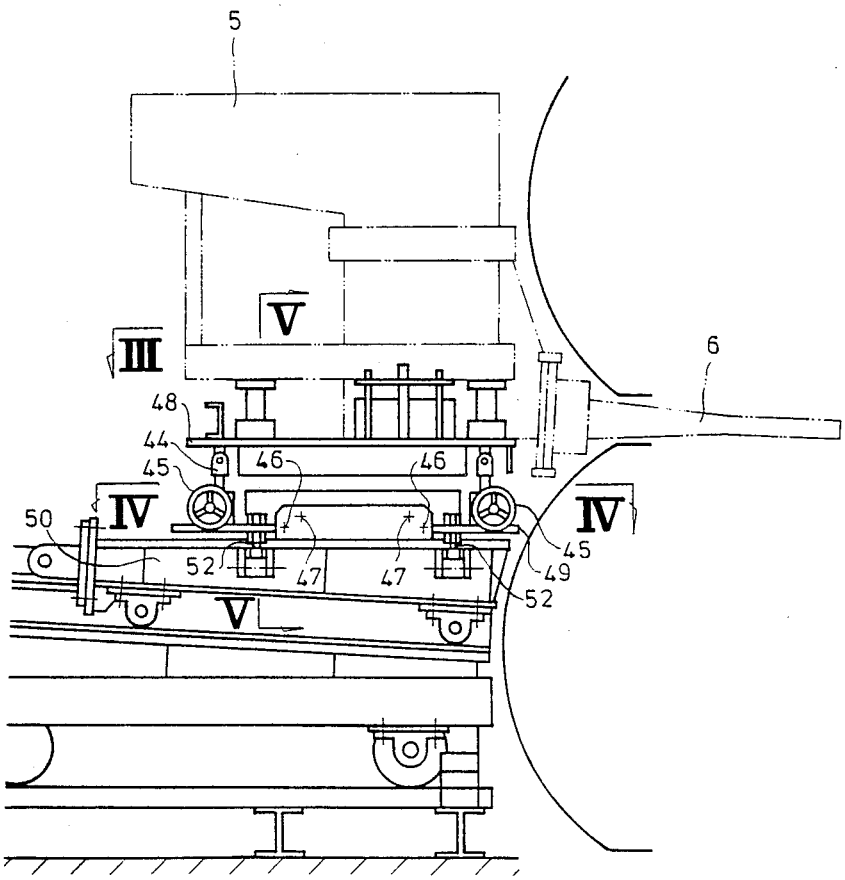
Fig.2 PRIOR ART
FIG. 2 is a side view used to explain one example of nozzle aligning system.
Figure 3:
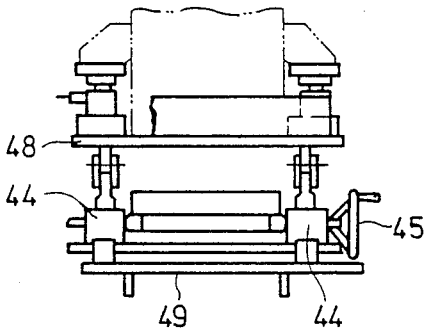
Fig.3 PRIOR ART
FIG. 3 is a view looking in the direction indicated by the arrow III of FIG. 2.
Figure 4:
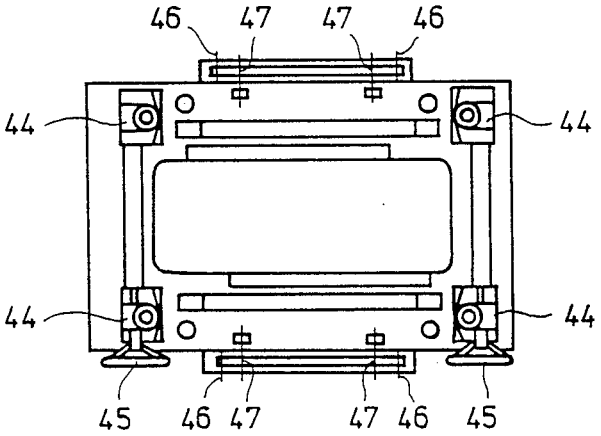
Fig.4 PRIOR ART
FIG. 4 is a view taken along the line IV—IV of FIG. 2.
Figure 5:
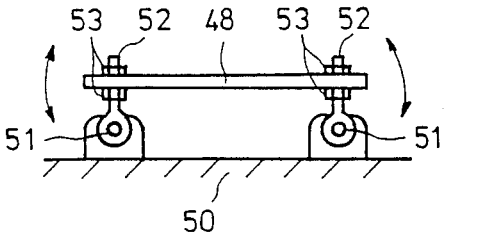
Fig.5 PRIOR ART
FIG. 5 is a view taken along the line V—V of FIG. 2.
Figure 6:
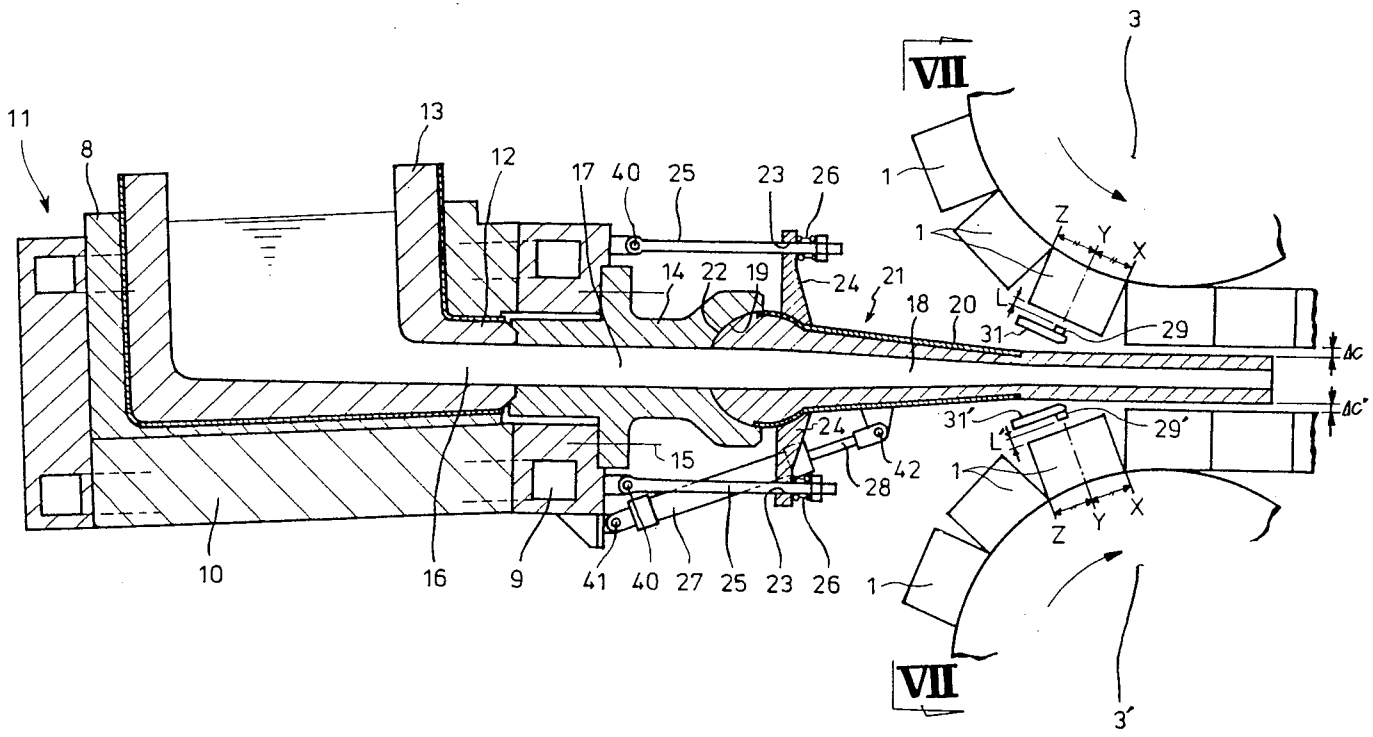
FIG. 6 is a side view of a preferred embodiment of the present invention.
Figure 7:
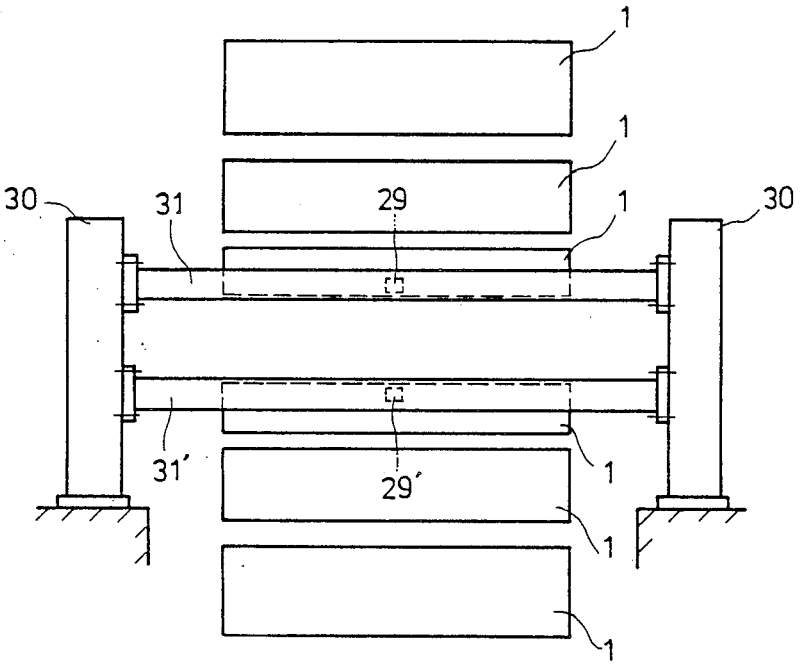
FIG. 7 is a view taken along the line VII—VII of FIG. 6.

Referring now to FIGS. 6–9, a preferred embodiment of the present invention will be described in detail. A tundish 13 having a short melt outlet 12 is mounted on a tundish car frame 11 comprising a tundish support 8 and a water-cooled jacket 10 with cooling water passages 9. An intermediate member 14 is securely attached to the car frame 11 with joint means 15 such as bolts in coaxial relationship with the axis of the melt outlet 12. The intermediate member 14 is made of a refractory material and has an axially extending melt pouring hole 17 which is coaxially joined to a melt pouring hole 16 of the melt outlet 12. An end of the member 14 away from the outlet 12 is formed with a semispherical recess 19.

A tundish nozzle 21 is made of a refractory material, surrounded by a steel shell 20 and has an axially extending melt hole 18 in coaxial relationship with the melt hole 17. A spherical projection 22 adapted to snugly fit into the semispherical recess 19 is formed at the base end of the tundish nozzle 21. Supporting brackets 24 each having a through hole 23 are securely attached to the upper and lower surfaces of the tundish nozzle 21. A guide rod 25 which is pivoted at its one end with a horizontally extending pin 40 to the tundish car frame 11 is slidably inserted into the through hole 23 of the bracket 24. The other end of the guide rod 25 carries spring means 26 such as a compression spring so as to normally bias the supporting bracket 24 toward the tundish car frame 11, whereby the tundish nozzle 21 is pressed against the intermediate member 14. A hydraulic cylinder 27 is pivoted at its base end to the tundish car frame 11 with a pin 41 which is in parallel with the pin 40. A rod 28 of the hydraulic cylinder 27 is pivoted at its leading end to the lower surface of the tundish nozzle 21 with a pin 42 which is in parallel with the pin 41 so that when the rod 28 is extended or retracted, the tundish nozzle 21 is tilted.

At an inlet to the mold cavity defined by the interconnected block molds 1, i.e., at a position where the block molds 1 moved around the drive wheels 3 and 3' have passed to be immediately in opposing relationship with each other, position sensors 29 and 29' such as eddy-current position sensors are securely fixed at the centers or midpoints of brackets 31 and 31' extending in the widthwise direction of the block molds 1 and bridging supporting columns 30 (see FIG. 7) so as to measure distances L and L' from the surfaces of the passing block molds 1.

Figure 8:
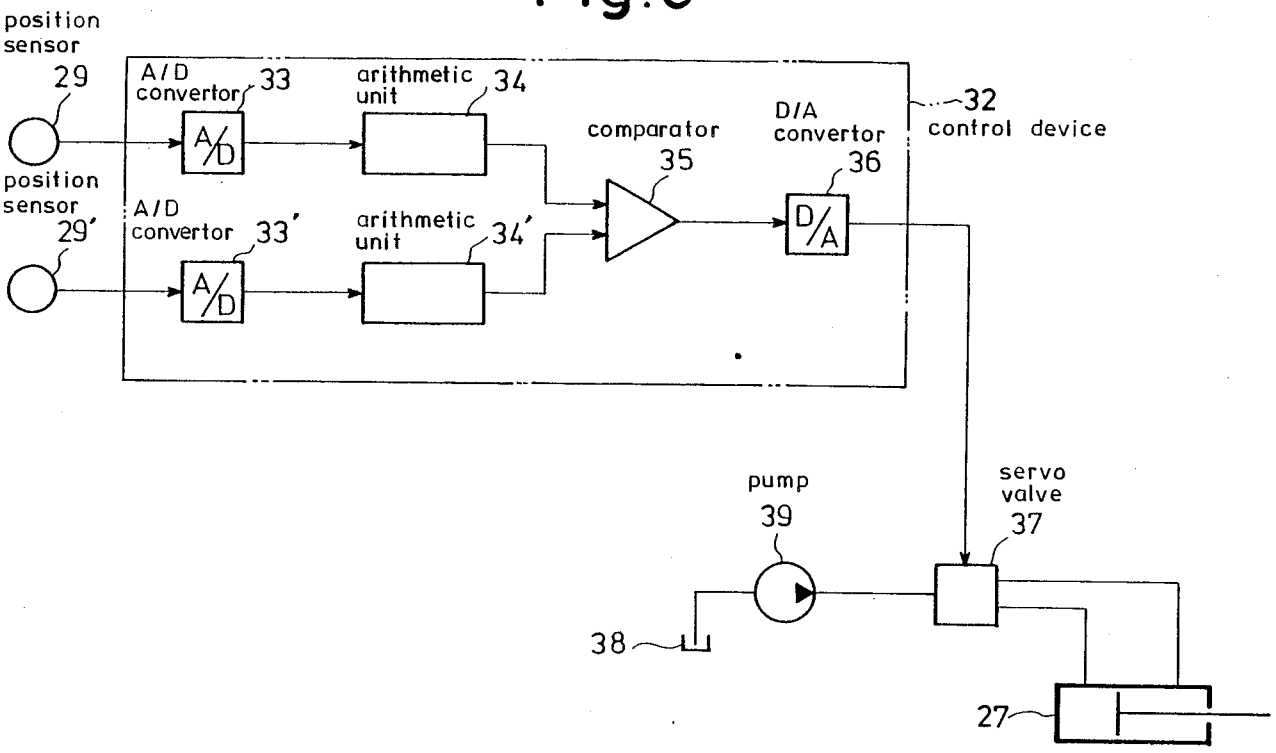
FIG. 8 is a block diagram illustrating a hydraulic-cylinder driving system.
Figure 9:
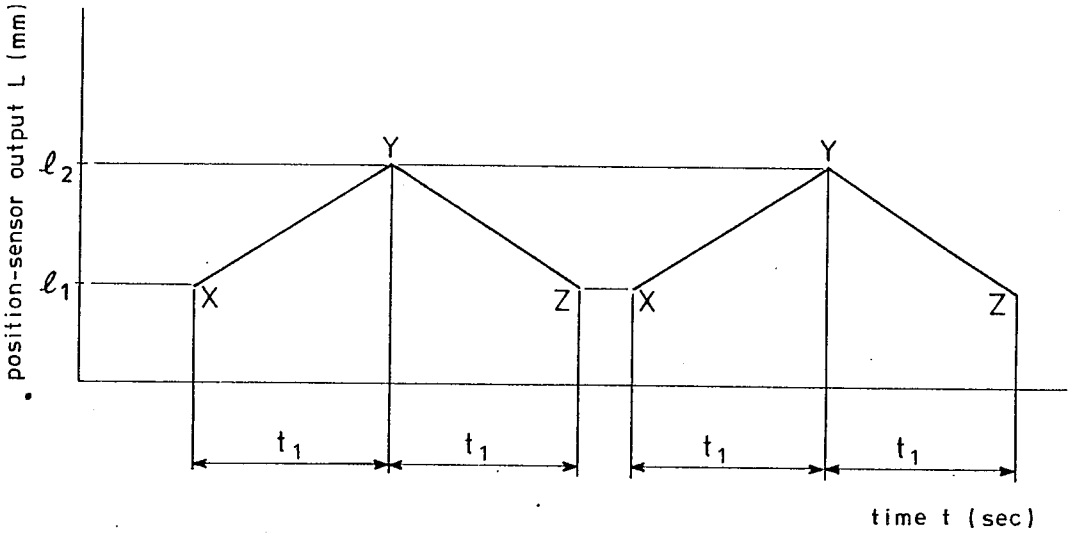
FIG. 9 is a graph illustrating the relation between position-sensor output and time.

As shown in FIG. 8, outputs of the position sensors 29 and 29' are delivered to a control device generally indicated by reference numeral 32 and the results of the arithmetic operations executed by the control device 32 are delivered to a servo valve 37 for driving the hydraulic cylinder 27.

The control device 32 comprises A/D converters 33 and 33', arithmetic units 34 and 34', a comparator 35 and a D/A converter 36. After the leading end X of the block mold 1 passes over the position sensor 29 and distance $l_1$ therebetween is measured and in the lapse of time interval $t_1$ determined on the basis of the moving velocity of the block molds 1, distance $l_2$ is measured to be picked up as distance at the midpoint Y of the block mold 1 (See FIG. 9); gap $\Delta c$ between the leading end of the tundish nozzle 21 and the block mold 1 corresponding to distance $l_2$ is calculated on the basis of data obtained in trial operation. In like manner, after the leading end X of the block mold 1 passes over the position sensor 29' and distance $l_1'$ therebetween is measured and in the lapse of time interval $t_1$ determined on the basis of the moving velocity of the block molds 1, distance $l_2'$ is measured to be picked up as distance at the midpoint Y of the block mold 1. Thereafter, gap $\Delta c'$ between the leading end of the tundish nozzle 21 and the block mold 1 corresponding to distance $l_2'$ is calculated on the basis of the data obtained in trial operation. Signals representative of gaps $\Delta c$ and $\Delta c'$ thus obtained are delivered to the comparator 35 after lapse of time of the block molds 1 coming into the opposing relationship with each other and the difference signal is delivered from the comparator 35 to the servo valve 37, whereby the hydraulic cylinder 27 is activated. In FIG. 8, reference numeral 38 designates a tank; and 39, a pump.

Next the mode of operation of the preferred embodiment with the above-described construction will be described.

First, in trial operation without using melt, gap $\Delta c$ and $\Delta c'$ between the leading end of the tundish nozzle 21 and the opposing block molds 1 corresponding to distance $l_2$ and $l_2'$, respectively, at the intermediate points Y of the block molds 1 are actually measured and the data thus obtained are inputted into the arithmetic units 34 and 34' in the control device 32.

In actual operation, distance L and L' measured by the position sensors 29 and 29' located at the inlet of the mold cavity defined by the block molds 1 are converted by the A/D converters 33 and 33' into digital signals which in turn are delivered to the arithmetic units 34 and 34' where distances $l_2$ and $l_2'$ at the midpoints Y of the block molds 1 are picked up on the basis of the moving velocity of the block molds 1 and gaps $\Delta c$ and $\Delta c'$ between the leading end of the tundish nozzle 21 and the opposing block molds 1 are obtained by arithmetic operation on the basis of the data obtained in trial operation. Signals representative of gaps $\Delta c$ and $\Delta c'$ thus obtained are delivered to the comparator 35 after lapse of time of the block molds 1 having reached the leading end of the tundish nozzle 21 so that difference between gaps $\Delta c$ and $\Delta c'$, i.e., deflection of the leading end of the tundish nozzle 21 toward the upper or lower block mold 1 is obtained. The difference signal thus obtained is converted by the D/A converter 36 into an analog signal which in turn is delivered to the servo valve 37 as signal for driving the hydraulic cylinder 27.

Thus, the servo valve 37 is driven to extend or retract the rod of the hydraulic cylinder 27 by a distance so that the tundish nozzle 21 is tilted or inclined about the portions 19 and 22, whereby gaps between the leading end of the tundish nozzle 21 and the opposing block molds 1 can be maintained substantially uniform to prevent the forcible contact of the leading end of the tundish nozzle 21 against the upper or lower block mold 1 which may otherwise result in local wear or breakdown of the leading end of the tundish nozzle 21.

Tilting movement of the tundish nozzle 21 due to extension or retraction of the rod of the hydraulic cylinder 27 does not result in leakage of melt from a connection of the nozzle 21 since the nozzle 21 is urged onto the intermediate member 14 by the spring means 26. Even when some deformation is caused to incline the axis of the melt outlet 12 of the tundish 13 with respect to the axis of the tundish nozzle 21, leakage of melt from the connection of the nozzle is prevented since no gap is produced thereat by interaction of the semispherical and spherical surfaces 19 and 22.

It is to be understood that the present invention is not limited to the preferred embodiment described above and that various modifications may be effected without leaving the true spirit of the present invention. For instance, a plurality of position sensors 29 and 29' may be arranged in spaced apart relationship in the widthwise direction of the block mold 1 so that when the tilt of the leading end of the tundish nozzle 21 is controlled in response to a mean value of outputs from the position sensors arranged in the widthwise direction of the mold 1, any inclination in the widthwise direction of the block mold 1 and any surface roughness of the block molds 1 do not adversely affect the positioning of the leading end of the tundish nozzle 21.

As described above, according to the pouring apparatus for the moving-mold type continuous casting machine of the present invention, gaps between the leading end of the tundish nozzle and the upper and lower opposing block molds can be always uniformly and properly maintained so that the local wear and breakdown of the tundish nozzle can be prevented and therefore the safety can be enhanced.

What is claimed is:

1. A pouring apparatus for a moving-mold type continuous casting machine comprising a tundish nozzle adapted to be tilted or inclined with respect to a melt output of a tundish, a hydraulic cylinder for tilting or inclining said tundish nozzle, position sensors disposed at an inlet of a mold cavity defined by upper and lower block molds each for detecting distance from a corresponding block mold passing past said inlet and a control device responsive to outputs from said position sensors for detecting deflection of a leading end of said tundish nozzle with respect to the upper and lower block molds, thereby outputting a drive signal to said hydraulic cylinder.

* * * * *